US006039291A

United States Patent [19]

Dobson, IV

[11] Patent Number: 6,039,291

[45] Date of Patent: Mar. 21, 2000

[54] TOY TRAIN CONTROL SYSTEM

[76] Inventor: Robert A. Dobson, IV, 733 Bennett St., Greenville, S.C. 29609

[21] Appl. No.: 09/059,692

[22] Filed: Apr. 13, 1998

[51] Int. Cl.[7] ..... B61L 5/00

[52] U.S. Cl. ..... 246/219; 246/263; 246/415 A

[58] Field of Search ..... 104/295, 301, 104/304, 305; 246/219, 263, 415 A

[56] References Cited

U.S. PATENT DOCUMENTS

| | | | |
|---|---|---|---|
| 3,218,452 | 11/1965 | Hughson . | |
| 5,050,505 | 9/1991 | Konno | 104/295 |
| 5,050,823 | 9/1991 | Parker | 246/219 |
| 5,085,148 | 2/1992 | Konno | 104/130 |
| 5,492,290 | 2/1996 | Quinn et al. | 246/219 |
| 5,541,695 | 7/1996 | Teremy et al. . | |
| 5,590,856 | 1/1997 | Quinn et al. . | |

*Primary Examiner*—S. Joseph Morano
*Assistant Examiner*—Robert J. McCarry, Jr.
*Attorney, Agent, or Firm*—Alston & Bird LLP

[57] ABSTRACT

A control system for use with a toy train system having a layout area including a track upon which a toy train runs includes a system component configured to operate within the toy train system and having a plurality of selective operative states. A control device remote from the system component is configured to emit a limited width visible light signal responsively to activation by an operator. A receiver mechanism is disposed in operative communication with the system component. The receiver mechanism is configured to receive the signal and to distinguish the signal from ambient light.

27 Claims, 3 Drawing Sheets

TOY TRAIN CONTROL SYSTEM

BACKGROUND OF THE INVENTION

One of the most vexing problems encountered in a toy train layout involves controlling turnouts. A turnout (often called a switch) is a track section that selectively connects two or more separate track sections to one or more track sections. When the train approaches the turnout along the single track section, the turnout's position determines on which of the two other tracks the train will continue. The turnout typically includes a sensor on each of the two separate track sections upstream from the junction to assure that, when the train approaches the turnout on one of these sections, the turnout allows the train to continue onto the single track. The construction and operation of the turnout, one example being the Lionel '022 turnout, should be well understood by those skilled in this art and are therefore not discussed in detail herein.

Layouts of all but the smallest size usually have many turnouts in different configurations spaced at varying intervals across the layout. A medium size layout, for example, may contain twenty to thirty turnouts, with larger layouts having fifty or more. As one or more toy trains travel around a layout, the turnouts must be thrown in different directions at different times in order for the trains to take varying routes. Timing becomes particularly important where multiple trains are used so that a collision may be avoided.

Various methods and devices are available to throw turnouts. For example, a turnout typically has a lever or knob so that the operator can reach across to the turnout and manually change its position. Of course, this method is inconvenient and is not practical for larger layouts. Thus, turnouts typically include an electronic switching mechanism which changes the turnout's position by activation of one or more solenoids. The electronic switching mechanism is, in turn, controlled by a switch at a central control panel convenient to the operator. With such a configuration, however, the operator must still visually identify a turnout, visually locate the appropriate control panel switch, and then activate the switch to change the turnout position. With a layout having several turnouts, and particularly where multiple trains are in use, this three-step procedure may introduce stress that detracts from enjoyment of the train layout.

Remote control systems have been developed to allow operator mobility while controlling turnouts. For example, Lionel's TRAIN MASTER COMMAND CONTROL SYSTEM utilizes a radio frequency (RF) remote controller to switch individual turnouts. To switch any given turnout, however, the operator must still visually identify the turnout, identify the button or buttons on the remote controller that correspond to that turnout, and activate these buttons on the remote controller keypad. Accordingly, while the remote controller allows the operator to move about the layout, it does not relieve the three-step burden of identifying the appropriate turnout, identifying the appropriate device to change the turnout, and activating that device.

Further, although some remote control devices may be pre-programmed to simultaneously switch a predetermined number of turnouts, independent turnout switching or selection among one of many pre-programmed sequences still requires the time-consuming procedure.

SUMMARY OF THE INVENTION

The present invention recognizes and addresses the forgoing disadvantages, and others, of prior art constructions and methods.

Accordingly, it is an object of the present invention to provide an improved toy train control system.

It is a further object to provide a system for controlling toy train layout components with a visible light signal.

Some of these objects are achieved by a control system for use within a toy train system having a layout area including a track upon which a toy train runs. The system includes a system component configured to operate within the toy train system and having a plurality of selective operative states. A control device remote from the system component is configured to emit a limited width visible light signal responsively to activation by an operator. A receiver mechanism is disposed in operative communication with the system component and is configured to receive the signal and to distinguish the signal from ambient light.

The accompanying drawings, which are incorporated by and constitute a part of this specification, illustrate one or more embodiments of the invention and, together with the description, serve to explain the principles of the invention.

BRIEF DESCRIPTION OF THE DRAWING

A full and enabling disclosure of the present invention, including the best mode thereof, directed to one of ordinary skill in the art, is set forth in the remainder of the specification, which makes reference to the appended drawings, in which.

Figure 1:
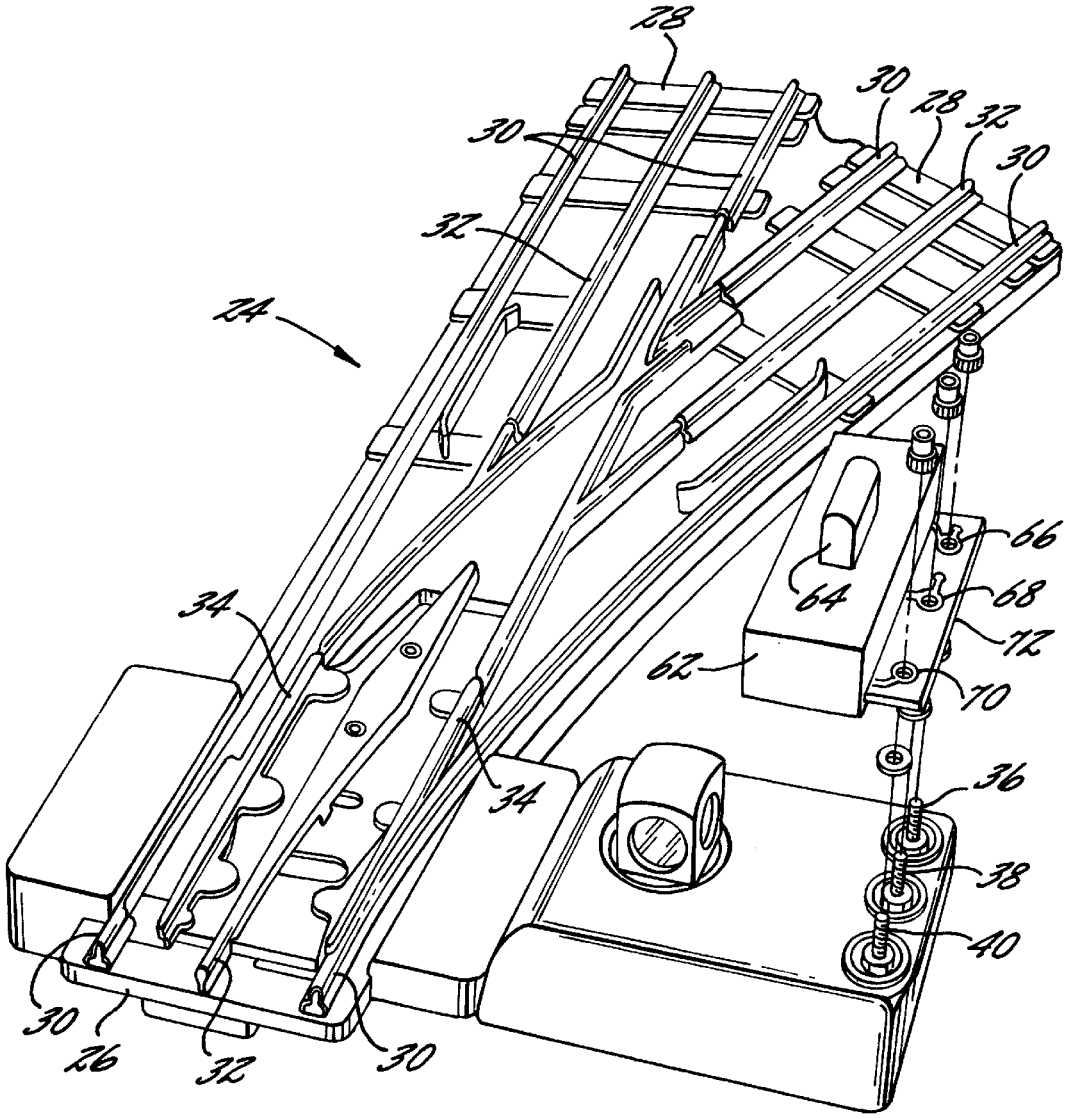
FIG. 1 is a perspective and partially exploded view of a track turnout and receiver mechanism in accordance with an embodiment of the present invention.

Repeat use of reference characters in the present specification and drawings is intended to represent same or analogous features or elements of the invention.

DETAILED DESCRIPTION OF PREFERRED EMBODIMENTS

Reference will now be made in detail to presently preferred embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Figure 4:
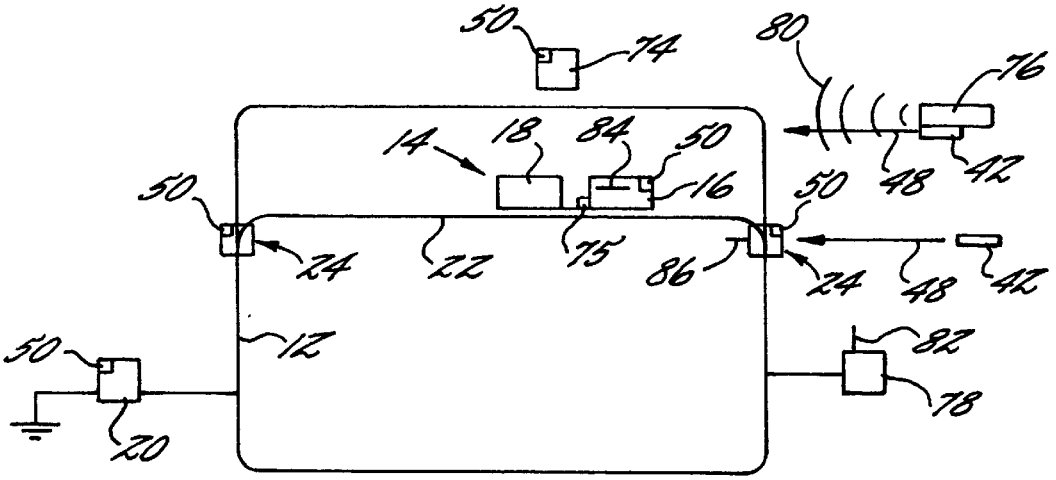
FIG. 4 is a diagrammatic illustration of a toy train system in accordance with the present invention.

The present invention is concerned with an improved toy train control system. Accordingly, FIG. 4 illustrates a toy train system 10 having a layout area including a track 12 on which runs a toy train 14 having an engine 16 and one or more cars 18. A transformer 20 provides electric current to track 12 to power engine 16 as should be understood in this art.

Track 12 may be of any suitable construction. For example, a track has three rails. The two outer rails carry a variable AC voltage signal, and the center track is AC common, carrying an AC signal at the same level but 180° out of phase with the two outer rails. While the embodiments described herein are discussed with respect to such a three rail system, it should be understood that this is for illustrative purposes only and that the present invention may be employed with other rail configurations.

As illustrated in FIG. 4, track 12 includes an intermediate track section 22 extending between two turnouts 24. A turnout 24 is illustrated in FIG. 1 and includes an input track section 26 and two output track sections 28. Each track section has two outer rails 30 and a center rail 32 as described above. It should be understood that the description of the turnout track sections as either input or output sections is to simplify the differentiation between the sections and is not intended to indicate the direction of the train along the turnout. For example, while a train may enter the turnout by way of input section 26 and exit by one of the output sections 28, it may also travel by the opposite direction.

Turnout 24 has two operative states. In the "through" position illustrated in FIG. 1, switching rails 34 operatively connect input track section 26 with the left hand output track 28. Switching rails 34 may, however, be thrown to the "out" position to operatively connect input track section 26 to the right hand output track section 28.

The switching rails 34 are controlled by a pair of solenoids (not shown), as should be understood in this art. Each solenoid is activated by a switch (not shown) which selectively connects one of the solenoids between the outer rail voltage and the center rail common voltage. The internal switch may be overridden, however, by electrically connecting posts 36 and 38 or posts 38 and 40. That is, shorting posts 36 and 38 activates one of the solenoids to place switching rails 34 in one position, while shorting posts 38 and 40 activates the other solenoid to place the switching rails in the other position. Accordingly, the turnout may be manually switched between the through and out positions by applying a jumper across one of these post pairs.

Figure 3:
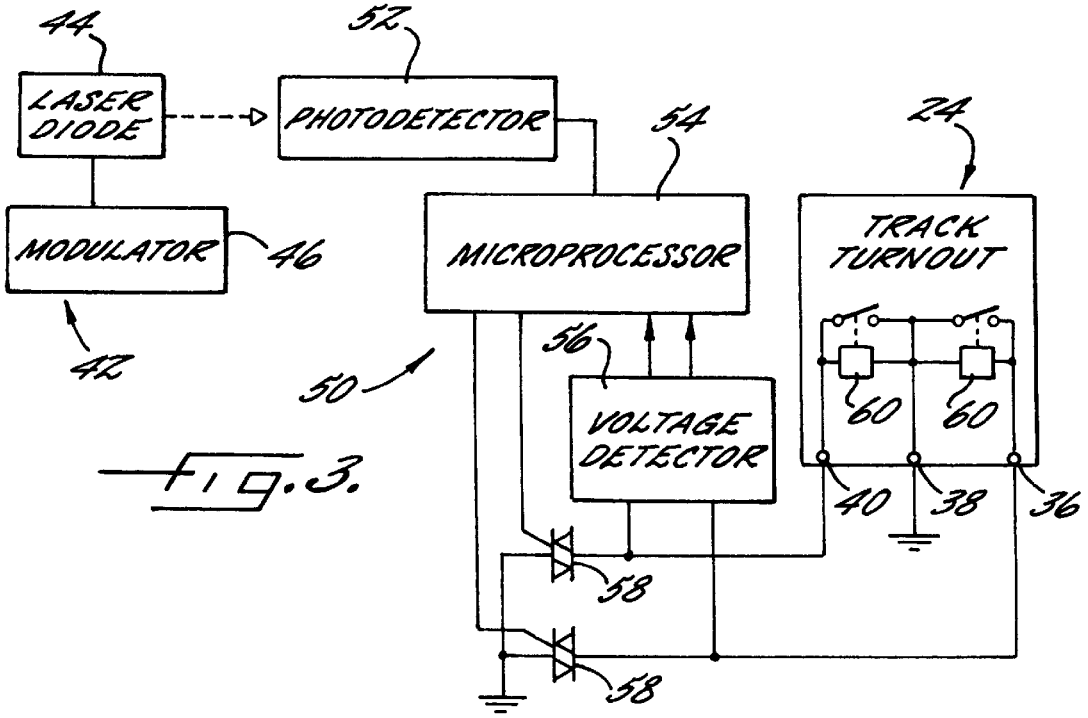
FIG. 3 is a block diagram illustration of a track turnout, receiver mechanism and control device in accordance with an embodiment of the present invention.

FIG. 3 illustrates a system for operating a turnout 24 through posts 36, 38 and 40. Specifically, a hand held control device 42 includes a laser diode 44 and a modulator 46. Laser diode 44 outputs a light signal 48 in the visible red range. Modulator 46 modulates the laser diode output so that the signal 48 is a 1 kHz square wave, ±50%.

A receiver mechanism 50 includes a photodetector 52, a microprocessor 54, a voltage detector 56 and a pair of triacs 58. Microprocessor 54, in conjunction with photodetector 52 and associated circuitry, detects the 1 kHz signal 48 and activates one of the triacs 58 responsively to receipt of this signal. Voltage detector 56 determines the state (through or out) of turnout 24 and provides this information to microprocessor 54 so that the microprocessor activates the appropriate triac 58. When activated, the triac 58 shorts the posts 38/40 or 38/36 across which it is connected in order to activate a corresponding solenoid 60 to change the turnout from one state to the other.

Receiver mechanism 50 is disposed in a housing 62 shown in FIG. 1. Photodetector 52 (FIG. 3) is disposed within an opaque silicone cap 64. Receiver mechanism 50 is electrically connected to posts 36, 38 and 40 by respective connections 66, 68 and 70 of a circuit board 72 extending from housing 62. Circuitry comprising photodector 52, microprocessor 54, voltage detector 56 and triacs 58 in the illustrated embodiment is disposed on board 72. Where housing 62 and board 72 are remote from the turnout, connections 66, 68 and 72 connected to posts 36, 38 and 40 extend from the board by wire leads.

Laser diode 44 may be part of a conventional laser light pen modified to produce a visible light signal within a frequency range to which the microprocessor 54 (FIG. 3) is programmed to respond. Accordingly, the operator may carry this portable device around the layout and throw a turnout merely by visually identifying the turnout and directing the laser light signal to cap 64. Cap 64 is preferably disposed on the receiver mechanism so that it is visible about a 360° horizontal arc, as shown in FIG. 1.

Accordingly, the operator may throw a turnout without moving his eyes from the train layout. He need only identify the turnout and direct the light beam to the detector device on or proximate the turnout. There is no need to determine a number or other identification associated with the turnout or to then locate a switch or button associated with that number. This significantly increases the speed and ease in which the operator may direct the train about the layout, thereby providing more time for the operator to perform other tasks.

It should be understood that the use of a control device and receiver mechanism in association with a track turnout is for illustrative purposes only. A receiver mechanism may be used in association with other train system components, such as log or coal loaders, transformers, train car mechanisms or lights within a layout lighting system.

Examples of such components are schematically illustrated in FIG. 4. For example, train speed in certain systems is controlled by transformer output. Accordingly, a receiver mechanism 50 associated with transformer 20 may be used to incrementally or continuously adjust the transformer output up or down in response to receipt of the laser signal. Two photodetectors may be provided, one for power increase and one for power decrease. Since the transformer may provide output power at many levels, this component has many operative states which may be selected through activation of the receiver mechanism. The receiver mechanism may be configured to activate a manual control mechanism provided on the transformer or may otherwise electrically adjust the transformer output.

The present invention may also be used to control components such as log loaders, indicated at 74, that operate in conjunction with train 14. A receiver mechanism 50 may be associated with the log loader to control the log loader's activating mechanism. Thus, when a train stops in the appropriate position at the log loader, receiver mechanism 50 may be activated by the laser signal to cause the loader to dump toy logs onto the appropriate train car. Coil couplers are used to couple toy train cars, for example engine 16 and car 18. A coupler 75 may include a receiving mechanism 50 so that the coupler is electrically opened when its receiving mechanism 50 receives a signal 48. Further, as discussed below, the present invention may be used to switch a component among a limited number, but more than two, discrete states.

The present invention may also be used to control the speed of train engine 16 in systems where train speed is not determined by rail voltage. For example, Lionel's TRAIN MASTER COMMAND CONTROL SYSTEM includes a CAB-1 hand controller to control turnouts, engines, car accessories and other layout components. Referring again to FIG. 4, the CAB-1 is a remote RF transmitter 76 that communicates with a command controller 78 by an RF signal 80 received by an antenna 82 on the command controller 78. Command controller 78 is hard-wired to the rails of track 12, which carries an 18 volt signal to provide power to the toy train engine and other system components.

The command controller modulates the 18 volt carrier signal to transmit signals through the toy train system. Since the modulated signals may be coded, the command controller may issue signals to control particular components. For example, the command controller may transmit signals peculiar to two train engines to independently run them at different speeds.

System components may receive the modulated rail signals in various suitable manners. For example components such as engine 16 may include an antenna 84 which receives command signals radiated from the rails of track 12. Alternatively, the engine may receive the command signals through its wheels.

To throw a turnout using this system, the operator identifies a particular turnout and presses the appropriate turnout number on the keypad of CAB-1 controller 76. The CAB-1 controller then sends an appropriate RF signal 80 to command controller 78, which outputs a signal peculiar to the desired turnout over the rails.

Command controller 78 may also switch turnouts in pre-programmed groups (sometimes referred to as "routes"). The turnouts in each group are entered through the CAB-1 controller, and the group is assigned a number. Subsequent activation of the group number at the CAB-1 controller causes the command controller 78 to simultaneously switch all turnouts in that group.

The present light communication system may be used to enhance this capability. A laser diode/modulator 42 is attached to, or constructed integrally with, CAB-1 controller 76. Each turnout includes a receiver mechanism 50, as discussed above, and an emitter such as antenna 86. Appropriate circuitry is provided between the receiver mechanism 50 and the antenna 86 so that when receiver mechanism 50 receives a visible light signal 48, antenna 86 radiates a radio frequency signal which identifies that particular turnout. Command controller antenna 82 receives this signal, and the command controller stores the identity of the turnout 24 from which the signal was received. A group number may be assigned to a group of turnouts 24 identified in this manner. Thereafter, an operator may simultaneously throw all turnouts within the group by entering the appropriate group number on the CAB-1 76 keypad, causing command controller 78 to issue appropriate command signals over the rails of track 12 to throw all turnouts within the group. Thus, by storing the turnouts' identifications and throwing the turnout group following receipt of a command from CAB-1 controller 76, command controller 78 throws the turnouts responsively to the RF signals received from antennas 86.

It should be understood that other suitable arrangements are possible. For example, antenna 82 and the associated circuitry for acquiring signals received therefrom may be separate from command controller 78, and signals acquired by the antenna and circuitry may be output to the command controller through a serial port. Further, it should also be understood that such a system may be used to control system components other than turnouts.

It should also be understood that various suitable communications arrangements may be employed within the present invention. For example, while radio frequency signals are discussed herein, it should be understood that any suitable electro-magnetic signal may be employed. Similarly, while the visible light signal 48 is described as being a laser signal and being within the visible red range, it should be understood that any suitable light signal generated by any suitable device and within the visible light spectrum is encompassed within the scope and spirit of the present invention.

Figure 2:
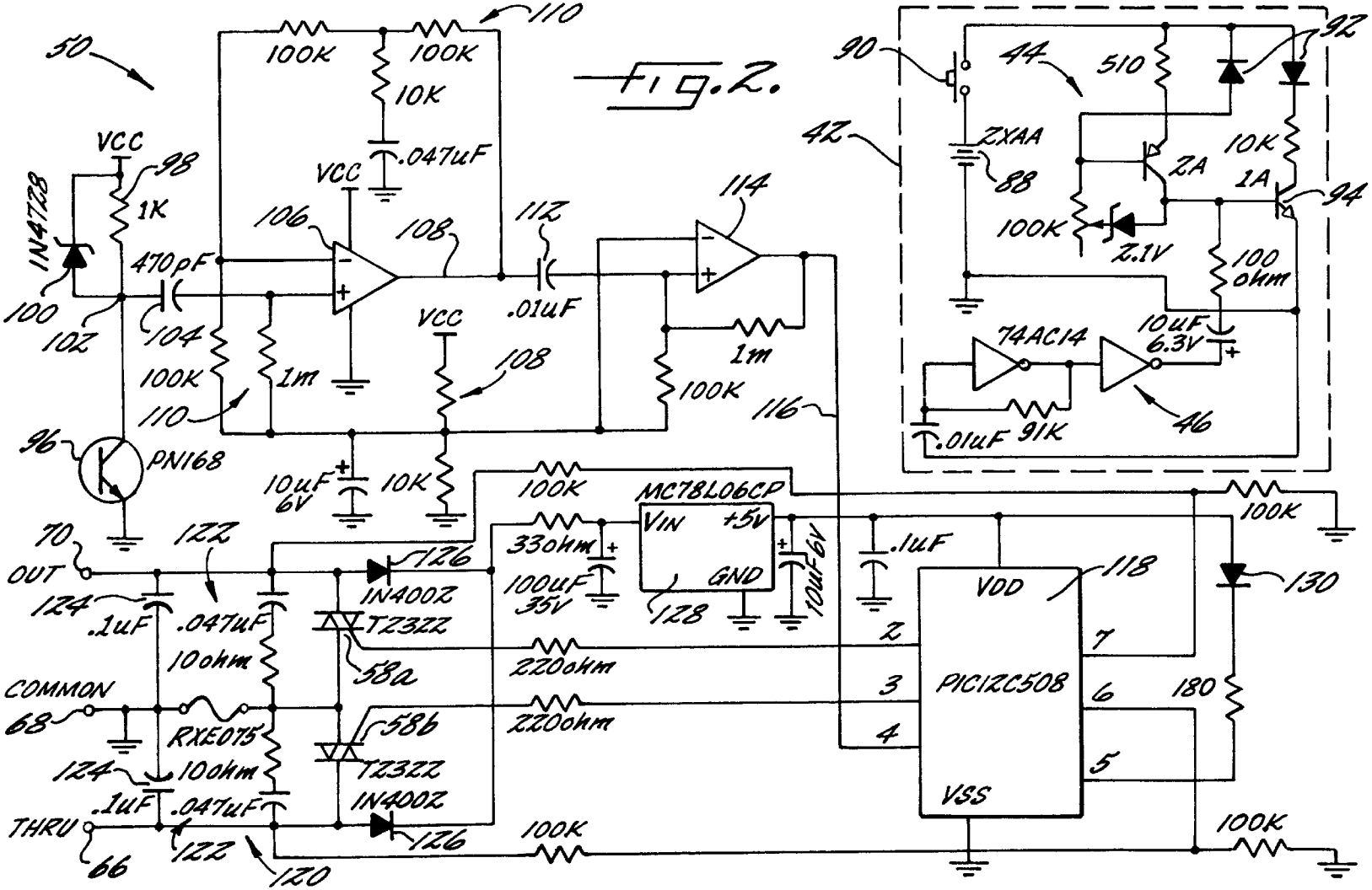
FIG. 2 is an electrical schematic illustration of a control device and receiver mechanism in accordance with an embodiment of the present invention.

FIG. 2 provides an electrical schematic illustration of the control device and receiver mechanism of FIG. 3. Laser device 44 includes a battery 88, a switch 90, and a laser diode mechanism 92. Modulation circuit 46 switches a transistor 94 on and off to produce a 1 kHz square wave, ±50%.

The laser signal output by laser diode mechanism 92 is of a limited width. That is, it is narrow enough so that when the beam is directed over a toy train layout (which may be 25 feet across or larger) to a receiver mechanism associated with one component, it is still narrow enough that it does not trigger a receiver mechanism associated with another component. For example, a light beam may be collimated or, as is common with conventional laser pointers, may be slightly divergent. In general, laser beam spread depends on the laser's manufacture and class. For example, regulations require that class 2 and class 3 lasers have at least a certain minimum spread. Such regulated beam spread requirements are generally acceptable within the present invention. Beam spread may be wider, however, as acceptable within the parameters of a given train system. In one embodiment, beam spread to an approximately one inch beam width or less at fifty feet from the control device is preferred. Further, in certain embodiments using laser light, class 2 lasers are preferred, although other laser types are possible. Depending on its configuration, a class 3 laser light pen may conform to class 2 standards when modulated to a 1 kHz signal.

Receiver mechanism 50 includes a photodetector 96 which reacts to any visible light. Photodetector 96 is a 30 volt, 20 milliamp NPN phototransister having a peak sensitivity wavelength of 800 nm. Photodetector 96 is disposed between ground and a biasing circuit including a resistor 98 and a zener diode 100 which provide 2.5 volts at node 102 when the phototransister is open. When the phototransister closes, node 102 goes approximately to ground.

In the embodiment illustrated in FIG. 2, photodetector 96 is very sensitive. It reacts to any visible light. Accordingly, the voltage at node 102 varies depending on the visible light incident on the photodetector. Node 102 would be at its highest level when there is no incident visible light. As the photodetector receives visible light, however, it provides less resistance to ground, thereby dropping the node 102 level. Thus, the voltage level at node 102 could change gradually throughout the day as ambient light provided through a window changes. As discussed below, however, the microprocessor looks for a signal change at a frequency between 500 Hz and 1500 Hz. This is provided by signal 48 (FIG. 3) from control mechanism 42, which pulses at a frequency of 1000 Hz, ±500 Hz. Thus, visible light signals outside this frequency range, for example 60 Hz signals produced by lamps, may affect the voltage level at node 102 but will not be recognized by the system as a signal requiring activation of the turnout. Accordingly, when using an embodiment of the present invention as shown in FIG. 2, an operating frequency range should be used outside the scope of naturally occurring ambient visible light signals. It should be understood, however, that the present invention is not limited to the configuration shown in FIG. 2 and that other suitable methods and apparatus for distinguishing the light signal from ambient light are included within the scope and spirit of the present invention.

The 500 Hz–1500 Hz signal 48 (FIG. 3) from control device 42 therefore opens and closes photodetector 96 at a frequency from 500 Hz to 1500 Hz, thereby changing the voltage level at node 102 somewhere between 2.5 volts and approximately ground at that frequency. This creates an oscillating signal that drives the rest of the system. It is not dependent upon the strength of the laser signal, which need only be strong enough to close photodetector 96. Accordingly, relatively incidental contact by the signal from laser diode 92 operates photodetector 96 to produce the oscillation at node 102. Thus, the receiver is able to receive and distinguish the laser signal over a relatively wide intensity range and reproduce the signal internally over a predetermined magnitude range at the frequency of the incoming laser signal.

A capacitor 104 filters DC or low frequency signals, for example 60 Hz electric light signals, from the node 102 signal, which drives an op amp 106. A second biasing circuit 108 provides 2.5 volts to resister pair 110 to provide the op amp's gain. Op amp 106 outputs a signal at 108 varying between 2 volts and 3 volts at the frequency of the node 102 signal. Circuit 110 includes a T-network amplifier and a low-pass filter having a pass range including frequencies between 500 Hz and 1500 Hz. Capacitor 112 is provided to remove any DC component that might be present in output 108. A second op amp 114 provides a ten times gain to output signal 108.

An output signal 116 from op amp 114 is directed to pin 4 of a microprocessor 118 that controls a switch circuit 120 that, in turn, controls the turnout 24 (FIG. 3). In one embodiment, the microprocessor is an eight bit MICROCHIP device. In general, microprocessor 118 controls switch circuit 120 to selectively short nodes 66/68 or nodes 70/68 as described above.

Microprocessor 118 shorts the terminals by activating triacs 58*a* and 58*b*. The triacs are normally off so that the turnout solenoids are not activated. The turnout switching rails thus remain in their prior position. To activate a given triac, microprocessor 118 outputs a logic one to that triac for 200 milliseconds to drive it to a closed position, thereby shorting the posts 36/38 or 40/38 to which its corresponding connections 70/68 or 68/66 are connected as shown in FIGS. 1 and 3. A snubbing circuit 122 is disposed across each triac to prevent the triac's undesirable closing. The snubbing circuit prevents sufficient current from passing between output nodes when the rails are not activated to switch the turnout. Capacitors 124 are included within snubbing circuits 122 to provide noise spike reduction.

VCC is established by a pair of diodes 126 which half-wave rectify the 18 volt outer rail signals. A voltage regulator 128 receives the rectified signal and provides a 5 volt output to the microprocessor and other components as indicated at VCC.

Microprocessor 118 also drives a SUPERBRITE LED from pin 5. This LED, the operation of which is described below, is located within cap 64 (FIG. 1) with photodetector 96. Where board 72 (FIG. 1) is remote from the turnout, for example attached under the layout board, cap 64, photodetector 96 and the LED may be remote from housing 62 (FIG. 1). The cap can be disposed on or proximate the turnout so that it encloses the two electrical components, which are connected to the rest of the circuitry shown in FIG. 2 by wires extending to the circuit board.

In operation, microprocessor 118 monitors the states of pins 6 and 7 at all times except when activating the triacs. These pins detect the state of the turnout since the voltage on the lines from either connection 70 or 66 (hereinafter referred to as line 70 or line 66) goes low when the turnout switches. The state to which the turnout moves is indicated by which line goes low. On newer turnouts, line 70 stays low when the turnout is in an out position, and line 66 stays high. Thus, microprocessor 118 may constantly confirm that the turnout is in an out position. The opposite is true when the turnout is in a through position. In older turnouts, the lines go low only momentarily as the turnout is being switched. Nonetheless, this is detected at pins 6 and 7 so that the microprocessor's memory may be set accordingly.

If one of lines 66 and 70 goes high, but the other does not go high within 1.5 milliseconds, the turnout is being switched. It is then necessary to change the turnout position register in the microprocessor's memory. The register is set to a "1" (out) if line 70 goes high and line 66 does not. The register is set to a "0" (through) if line 66 goes high and line 70 does not. In this way, the microprocessor knows the state of the turnout at all times and therefore knows which triac should be activated to throw the turnout to the opposite position.

The microprocessor also monitors the input at pin 4 at all times, except when activating the triac, to detect a signal between 500 and 1500 Hz. When such a signal is detected, the microprocessor takes three samples to assure that the signal is consistently within this range. It is also possible to make sure that the frequency is constant. For example, if a 900 Hz signal is detected, a valid signal may be declared when the subsequent two measurements result in a signal having a frequency of 900 Hz ±10%.

If such a signal is detected, the microprocessor drives the appropriate triac 58*a* or 58*b* on to switch the turnout to the opposite position from that indicated in the microprocessor's register. At this time, the microprocessor also changes the value in the memory register to reflect the change in the turnout's operative state. Following the change, microprocessor 118 drives LED 130 to notify the user that the change is completed. The LED flashes once when the turnout is moved to the "through" position and twice when moved to the "out" position.

Microprocessor 118 has a debouncing delay of about one second when operating a triac. That is, upon receiving an appropriate signal at pin 4, the microprocessor activates the appropriate triac for 200 milliseconds to activate the appropriate solenoid. It does not recognize another signal at pin 4, however, during this time or for another 800 milliseconds. This prevents an operator from unintentionally switching the turnout back to the original position by holding the laser on the detector for too long a period. Of course, should the operator hold the laser at the detector for more than approximately one second, the turnout will switch back to the original position.

As noted above, the present invention may be used with system components other than turnouts. Accordingly, the circuitry illustrated in FIG. 2 may be altered to fit the needs of a particular component. Many components, for example log loaders, are operated by simple switches where it is unnecessary to monitor the state of the switch. Thus, rather than the dual triac arrangement of circuit 120, microprocessor 118 may electrically control a mechanical relay, for example by a single solenoid, to change the switch from one position to the other. In this case, the triacs would be removed from the circuit of FIG. 2, as well as the resistors between the triacs and the microprocessor. Also, the circuitry from microprocessor pins 6 and 7 to lines 66 and 70, respectively, is removed. Pin 6 controls a transistor which drives one end of the relay coil to ground. The other side of the coil is connected to power through a transistor, zener diode and resistor circuit that provides twelve volts to the coil. An EPROM is connected to pins 2 and 3 to store information regarding the system. The microprocessor is programmed to save data to the EPROM regarding the circuit settings so that the component remains in its position over a power out and subsequent power up.

As a further example, the microprocessor may control four relays, each controlling a separate component. In this embodiment, pins 6 and 7, which in combination can have four output states, output to a logic circuit in communication with the four relays. Depending on which of the four possible output signals pins 6 and 7 output to the logic circuit, the logic circuit drives a corresponding one of the relays. Each relay coil is connected between power (which may again be provided by the rail voltage) and ground as described above.

To activate a particular relay, an operator presses an appropriate one of four buttons on the laser controller. Each button connects a distinct modulating circuit to the laser driver to select the frequency of the pulsed laser signal. Each modulating circuit creates a particular output frequency, for example 1 kHz, 3 kHz, 5 kHz or 7 kHz, each variable by ±500 Hz. The receiver is configured to pass these frequencies (thus, for example, circuit 110 is configured appropriately), and the microprocessor is programmed to activate a given relay when a signal of a given frequency is detected.

In this arrangement, the cap 64 (FIG. 1) enclosing photodetector 96 is remote from the four components. LED 130 may be included to notify the operator that a relay has switched. This arrangement may also be used in conjunction with a single component having more than two discrete states.

While one or more preferred embodiments of the invention have been described above, it should be understood that any and all equivalent realizations of the present invention are included within the scope and spirit thereof. The embodiments depicted are presented by way of example only and are not intended as limitations upon the present invention. Thus, it should be understood by those of ordinary skill in this art that the present invention is not limited to these embodiments since modifications can be made. Therefore, it is contemplated that any and all such embodiments are included in the present invention as may fall within the literal or equivalent of the scope of the appended claims.

What is claimed is:

1. A control system for use within a toy train system having a layout area including a track upon which a toy train runs, said control system comprising:

a system component configured to operate within said toy train system and having a plurality of selective operative states;

a control device remote from said system component and configured to emit a limited width visible light signal responsively to activation by an operator; and a receiver mechanism disposed in operative communication with said system component, said receiver mechanism being configured to receive said signal and to distinguish said signal from ambient light.

2. The system as in claim 1, wherein said receiver is configured to change said system component from a first said state to a second said state responsively to receipt of said signal.

3. The system as in claim 1, wherein said system component is a track turnout.

4. The system as in claim 3, wherein said track turnout has an input track section, a first output track section, a second output track section, and a switching mechanism in operative communication with said receiver mechanism, wherein in said first operative state said switching mechanism connects said input track section to said first output track section, and wherein in said second operative state said switching mechanism connects said input track section to said second output track section.

5. The system as in claim 1, wherein said system component is a variable power source providing electric power to at least a part of said layout, wherein in said first operative state said power source provides a first power level, and wherein in said second operative state said power source provides a second power level.

6. The system as in claim 1, wherein said system component is a toy train car.

7. The system as in claim 6, wherein said toy train car has a coil coupler that in said first operative state is in an open condition and in said second operative state is in a closed condition.

8. The system as in claim 1, including a plurality of said system components.

9. The system as in claim 1, wherein said signal is a laser signal.

10. The system as in claim 1, wherein said control device is portable.

11. The system as in claim 1, wherein said system component includes an emitter in operative communication with said receiver mechanism, said emitter configured to emit an electromagnetic signal responsively to receipt by said receiver of a said limited width visible light signal, wherein said control device includes a secondary receiver configured to receive said electromagnetic signal from said emitter, and wherein said control device is in operative communication with said system component and is configured to change said system component from a first said state to a second said state responsively to receipt of said electromagnetic signal.

12. The system as in claim 11, wherein said electromagnetic signal is an infrared signal.

13. The system as in claim 11, wherein said control device includes an emitter configured to emit an electromagnetic signal and wherein said system component includes a secondary receiver configured to receive said electromagnetic signal from said control device emitter and to change said system component from said first operative state to said second operative state responsively thereto.

14. The system as in claim 13, wherein said receiver mechanism and said secondary receiver are separate devices.

15. The system as in claim 13, wherein said emitter includes at least one rail of said track and wherein said secondary receiver includes an antenna disposed within said system component.

16. A control system for use within a toy train system having a layout area including a track upon which a toy train runs, said control system comprising:

a system component configured to operate within said toy train system and having a plurality of selective operative states;

a portable control device remote from said system component and configured to emit a limited width visible light signal responsively to activation by an operator; and a receiver mechanism disposed in operative communication with said system component, said receiver mechanism being configured to receive said signal, distinguish said signal from ambient light, and change said system component from a first said state to a second said state responsively to receipt of a said signal.

17. The system as in claim 16, wherein said signal is a laser signal.

18. The system as in claim 16, wherein said system component is a track turnout having an input track section, a first output track section, a second output track section, and a switching mechanism in operative communication with said receiver mechanism, wherein in said first operative state said switching mechanism connects said input track section to said first output track section, and wherein in said second operative state said switching mechanism connects said input track section to said second output track section.

19. A control system for use within a toy train system having a layout area including a track upon which a toy train runs, said control system comprising:

a track turnout having an input track section, a first output track section, a second output track section, and a-switching mechanism, wherein in a first operative state said switching mechanism connects said input track section to said first output track section, and wherein in a second operative state said switching mechanism connects said input track section to said second output track section;

a portable control device remote from said system component and configured to emit a limited width visible laser light signal responsively to activation by an operator; and a receiver mechanism disposed in operative communication with said track turnout switching mechanism, said receiver mechanism being configured to receive said signal, distinguish said signal from ambient light, and change said track turnout from said first state to said second state responsively to receipt of a said signal.

20. A control system for use within a toy train system having a layout area including a track upon which a toy train runs, said control system comprising:

a system component configured to operate within said toy train system and having a plurality of selective operative states;

means for emitting a limited width visible light signal responsively to activation by an operator, said emitting means being remote from said system component; and means for receiving said signal and distinguishing said signal from ambient light, said receiving means being disposed in operative communication with said system component.

21. A toy train system, said system comprising:

a track;

a power source;

a toy train configured to travel on said track under power of said power source;

a system component configured to operate within said toy train system and having a plurality of selective operative states;

a control device remote from said system component and configured to emit a limited width visible light signal responsively to activation by an operator; and a receiver mechanism disposed in operative communication with said system component, said receiver mechanism being configured to receive said signal and to distinguish said signal from ambient light.

22. The system as in claim 21, wherein said receiver is configured to change said system component from a first said state to a second said state responsively to receipt of said signal.

23. The system as in claim 21, wherein said system component is a track turnout.

24. The system as in claim 23, wherein said track turnout has an input track section, a first output track section, a second output track section, and a switching mechanism in operative communication with said receiver mechanism, wherein in said first operative state said switching mechanism connects said input track section to said first output track section, and wherein in said second operative state said switching mechanism connects said input track section to said second output track section.

25. The system as in claim 21, including a plurality of said system components.

26. The system as in claim 21, wherein said signal is a laser signal.

27. The system as in claim 21, wherein said control device is portable.

* * * * *